US007654242B2

(12) United States Patent
Kinoshita

(10) Patent No.: US 7,654,242 B2
(45) **Date of Patent: *Feb. 2, 2010**

(54) MULTIPLE-CYLINDER ENGINE FOR PLANING WATER VEHICLE

(75) Inventor: Yoshimasa Kinoshita, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 38 days.

This patent is subject to a terminal disclaimer.

(21) Appl. No.: 11/965,290

(22) Filed: Dec. 27, 2007

(65) Prior Publication Data

US 2009/0042458 A1 Feb. 12, 2009

(30) Foreign Application Priority Data

Aug. 10, 2007 (JP) ..... 2007-209864

(51) Int. Cl.
*F02D 13/06* (2006.01)

(52) U.S. Cl. ..... 123/198 F; 123/198 DB; 440/38; 440/1

(58) Field of Classification Search ..... 123/198 F, 123/481, 332, 334, 351, 394, 198 DB, 295; 440/38

See application file for complete search history.

(56) References Cited

U.S. PATENT DOCUMENTS 4,224,920 A * 9/1980 Sugasawa et al. ..... 123/198 F
4,276,863 A * 7/1981 Sugasawa et al. ..... 123/481
5,161,503 A * 11/1992 Yano et al. ..... 123/335
5,540,633 A * 7/1996 Yamanaka et al. ..... 477/107
5,797,371 A * 8/1998 Nonaka ..... 123/481
5,970,951 A * 10/1999 Ito ..... 123/335
6,263,839 B1 * 7/2001 Hoshiba et al. ..... 123/41.08
6,364,726 B1 * 4/2002 Motose et al. ..... 440/86
6,470,852 B1 * 10/2002 Kanno ..... 123/339.23
6,848,956 B2 * 2/2005 Ozawa ..... 440/1
7,073,488 B2 * 7/2006 Hasler et al. ..... 123/481
2003/0131820 A1 * 7/2003 Mckay et al. ..... 123/198 F
2005/0193987 A1 * 9/2005 Doering ..... 123/479
2005/0199220 A1 * 9/2005 Ogiso ..... 123/481
2009/0042463 A1 * 2/2009 Kinoshita ..... 440/38

FOREIGN PATENT DOCUMENTS

JP 2002-371875 12/2002

* cited by examiner

*Primary Examiner*—Michael Cuff
*Assistant Examiner*—Hung Q Nguyen
(74) *Attorney, Agent, or Firm*—Keating & Bennett, LLP.

(57) ABSTRACT

A multiple-cylinder engine for a planing water vehicle includes an operation control device which changes the number of deactivated cylinders step by step in response to an engine speed when the engine speed exceeds a preset speed. The operation control device can have a plurality of cylinder deactivation order maps used for instructing an increment order of cylinders which are deactivated step by step when the engine speed exceeds the preset speed. The operation control device can exchange one of the cylinder deactivation order maps which is currently used for another one of the maps in accordance with an operation state of the engine.

11 Claims, 7 Drawing Sheets

MULTIPLE-CYLINDER ENGINE FOR PLANING WATER VEHICLE

PRIORITY INFORMATION

The present application is based on and claims priority under 35 U.S.C. § 119(a-d) to Japanese Patent Application No. 2007-209864, filed on Aug. 10, 2007, the entire contents of which is expressly incorporated by reference herein.

BACKGROUND OF THE INVENTIONS

1. Field of the Inventions

The present inventions relate to multiple-cylinder engines, and more particularly to engines having an operation control device which changes the number of deactivated cylinders.

2. Description of the Related Art

Some known planing-type water vehicles include systems which disable respective cylinders of their engines. For example, these systems can be used to prevent over-revolution of the engine of a planing-type vehicle when the vehicle is operating in a planing state. Such a system is described in Japanese Patent Document JP-A-2002-371875.

The over-revolution state does not occur frequently in the engine of an ordinary automobile. However, because a water inlet opening for a jet pump of a planing-type water vehicle can rise out of the water and be exposed to the air, the jet pump can suck air in and relatively often cause the over-revolution state of the associated engine.

SUMMARY OF THE INVENTIONS

An aspect of at least one of the embodiments disclosed herein includes the realization that although step-by-step cylinder deactivation can enhance operation, the known systems can cause a problem that loads for respective cylinders of the engine differ from each other. This is because an order of deactivated cylinders is fixed, and the cylinders whose deactivation turn comes later can have higher risk for causing an over-speed state than the cylinders whose deactivation turn come earlier.

Thus, in accordance with an embodiment, a multiple-cylinder engine for a planing water vehicle can comprise an operation control device configured to change the number of deactivated cylinders step by step in response to an engine speed when the engine speed exceeds a preset speed. The operation control device can comprise a plurality of cylinder deactivation order maps, and the operation control device can be configured to use the deactivation order maps in deactivating the cylinders of the engine in an incremental order, step by step when the engine speed exceeds the preset speed. The operation control device can also be configured to exchange one of the cylinder deactivation order maps which is currently used for another one of the maps in accordance with an operation state of the engine.

In accordance with another embodiment, a multiple-cylinder engine for a planing water vehicle can comprise an operation control device configured to change the number of deactivated cylinders step by step in response to an engine speed when the engine speed exceeds a preset speed. The operation control device can comprise a plurality of cylinder deactivation order maps, and the operation control device being configured to use the deactivation order maps in deactivating the cylinders of the engine in an incremental order, step by step when the engine speed exceeds the preset speed. The operation control device can also comprise means for exchanging one of the cylinder deactivation order maps which is currently used for another one of the maps in accordance with an operation state of the engine.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures.

DETAILED DESCRIPTION OF THE PREFERRED EMBODIMENT

Figure 1:
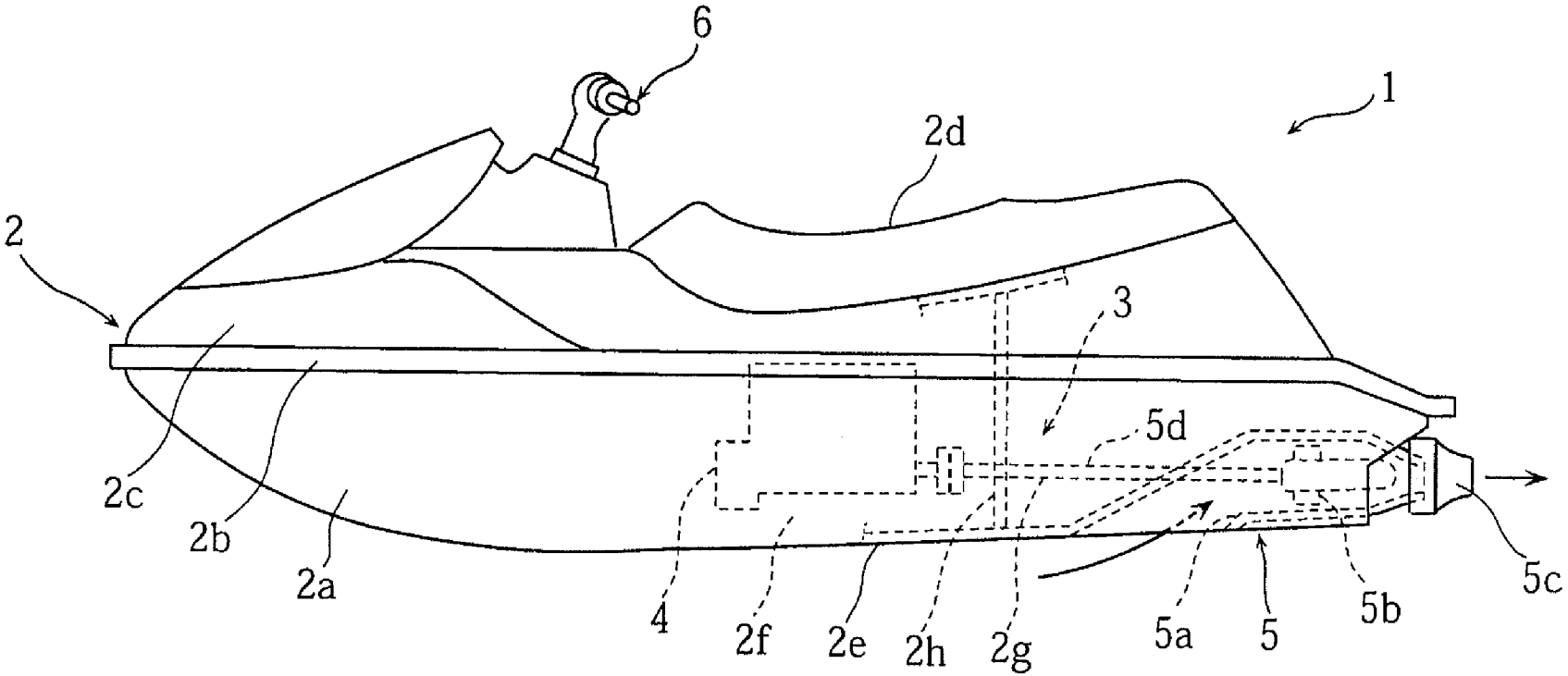
FIG. 1 is a left side elevational view of a small planing-type water vehicle having a multiple-cylinder engine configured in accordance with an embodiment.

FIG. 1 illustrates a small water vehicle 1 having an engine in accordance with several embodiments. The various embodiments of the engine are disclosed in the context of a small water vehicle because it has particular utility in this context. However, the engines disclosed herein can be used in other contexts, such as, for example, but without limitation, outboard motors, inboard/outboard motors, and for engines of other vehicles including land vehicles.

With reference to FIG. 1, a vehicle body 2 of the small planing water vehicle 1 can be made of resin (FRP) and can comprise a hull 2*a* located on a lower portion and a deck 2*b* located on an upper portion, both of which can be sealingly coupled with each other through a bond flange which can extend along a gunwale 2*c*. A straddle type seat 2*d* can be mounted on the deck 2*b*. A steering handle 6 can be disposed in front of the seat 2*d*.

The steering handle 6 can have a handle bar 6*a* supported for pivotal movement rightward or leftward. Right and left ends of the handle bar 6*a* can have grips 6*b*, 6*b* which can be configured to be grasped by an operator. The right grip 6*b* can have a throttle lever 6*c*. However, other configurations can also be used.

The vehicle body 2 can be steered when the handle bar 6*a* is pivoted rightward or leftward. A speed of the vehicle body 2 increases when the throttle lever 6*c* is pulled toward the handle bar 6*a*.

A propulsion system 3 can be disposed in the interior of the vehicle body 2 and can be configured to propel the vehicle body 2. The propulsion system 3 can include an engine 4 disposed in an engine compartment 2*f* of the vehicle body 2 and a water-jet pump 5 disposed in a pump compartment 2*g* of the vehicle body 2. The engine 4 can be configured to power the water-jet pump 5, e.g., to rotate an impeller 5*b* within the water-jet pump 5. Reference numeral 2*h* identifies a bulkhead dividing the interior of the vehicle body 2 into the engine compartment 2*f* and the pump compartment 2*g*. However, other configurations can also be used.

The water-jet pump 5 can have a duct 5*a* opening in a bottom surface 2*e* of the vehicle body 2. The impeller 5*b* can be disposed within the duct for rotation and can be coupled with an output shaft of the engine 4 through a coupling shaft 5*d*. In some embodiments, the coupling shaft can be made from a single shaft member or a plurality of shafts connected together with, for example, splined connections.

A steering deflector 5*c* can be disposed at an outlet port of the duct 5*a*. The steering deflector 5*c* can be configured to pivot rightward or leftward with the pivotal movement of the steering handle 6 in the right or left direction to change an advance direction of the vehicle body 2. However, other configurations can also be used.

The engine 4 can be a four stroke, in-line, four cylinder type engine having a first cylinder A, a second cylinder B, a third cylinder C and a forth cylinder D disposed in line along a crankshaft 7. The engine 4 can be mounted in the engine compartment 2*f* with the crankshaft 7 extending in a fore to aft direction of the vehicle body 2. However, this is merely one type of engine that can be used with the inventions disclosed herein. Engines having a different number of cylinders, other cylinder arrangements, various cylinder orientations (e.g., upright cylinder banks, V-type, and W-type), and operating on various combustion principles (e.g., four stroke, crankcase compression two-stroke, diesel, and rotary) are all practicable for use with the inventions disclosed herein.

Figure 3:
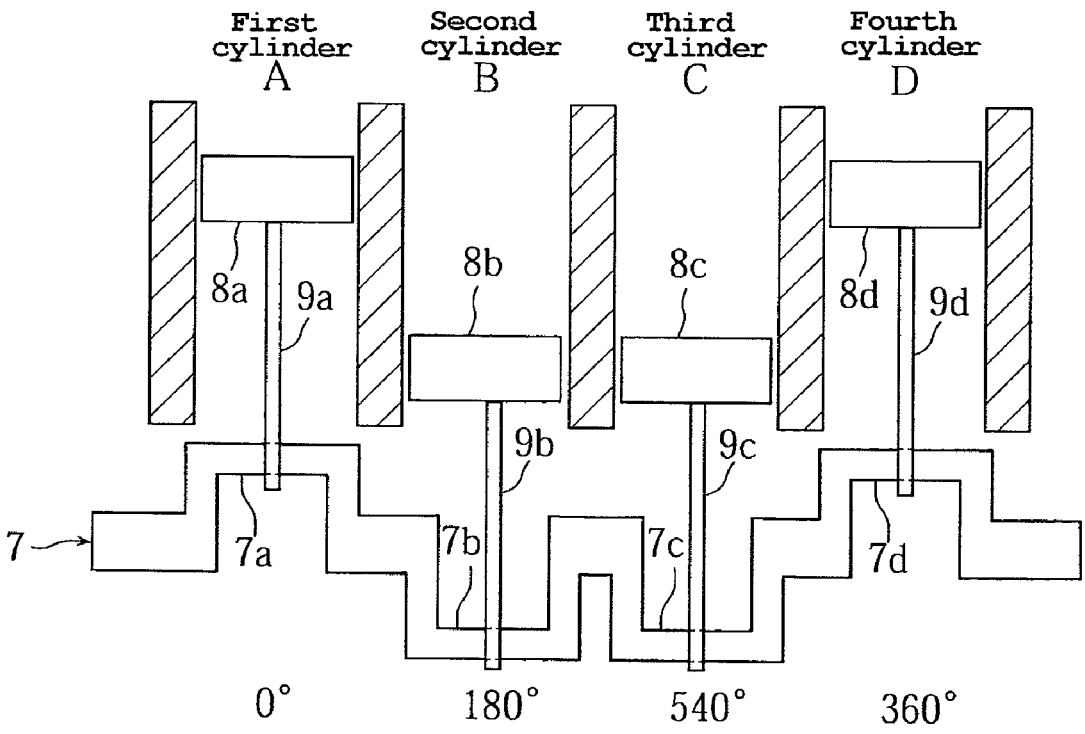
FIG. 3 is a schematic illustration depicting a crankshaft and cylinder arrangement.

With reference to FIG. 3, pistons 8*a*-8*d* of the first cylinder A through the fourth cylinder D can be connected to a first crank pin 7*a* through a fourth crank pin 7*d* through connecting rods 9*a*-9*d*, respectively. If a phase angle of the first crank pin 7*a* is 0°, respective phase angles of the second, third and fourth crank pins 7*b*, 7*c*, 7*d* can be 180°, 540° and 360°. The first cylinder A, the second cylinder B, the fourth cylinder D and the third cylinder C are ignited in this order. However, other configurations can also be used.

Figure 2:
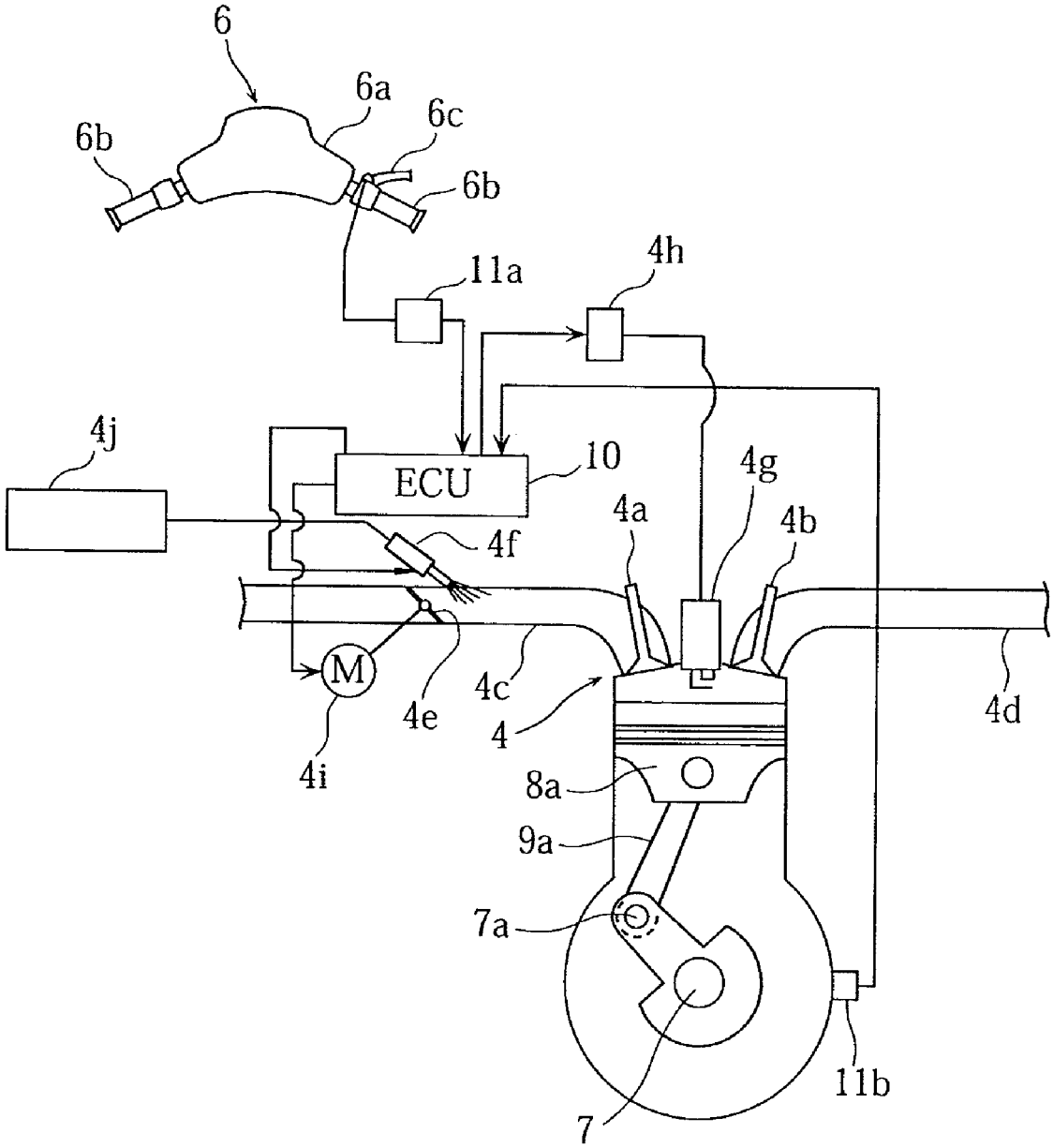
FIG. 2 is a schematic block diagram of the engine.

With continued reference to FIG. 2, an intake valve 4*a* of each cylinder opens or closes a combustion chamber opening through which an intake port 4*c* communicates with a combustion chamber of the cylinder, while an exhaust valve 4*b* of the cylinder opens or closes another combustion chamber opening through which an exhaust port 4*d* communicates with the combustion chamber. Electrodes of an ignition plug 4*g* are positioned in the combustion chamber of each cylinder. An ignition coil 4*h* can be connected to the ignition plug 4*g*.

A throttle valve 4*e* can be disposed midway of each intake port 4*c* to adjust a passage area (opening degree) of the port 4*c*. A fuel injector 4*f* can be disposed downstream of the throttle valve 4*e*. A throttling motor 4*i* can be configured to adjust the opening degree of the throttle valve 4*e* in response to an operational amount of the throttle lever 6*c* by the operator. Each fuel injector 4*f* can be connected to a fuel supply system 4*j* including a fuel tank, a fuel pump, etc. However, other configurations can also be used.

The engine 4 can have an accelerator position sensor 11*a* configured to detect a position (operated angle) of the throttle lever 63, a crankshaft angle sensor 11*b* configured to detect a rotational angle of the crankshaft 7 and an ECU 10 to which detection signals are input from the sensors 11*a*, 11*b*. The ECU 10 can also be configured to calculate an engine speed based upon a crankshaft angle detected by the crankshaft angle sensor 11*b*.

The ECU 10 can be configured to control the throttle valves 4*e* through the throttling motor 4*i* in response to an operational amount of the throttle lever 6*c* operated by the operator. The ECU 10 can also be configured to control open timing and an open period of each fuel injector 4*f*, ignition timing of each ignition plug 4*g*, etc. Thereby, the ECU 10 controls all the states of operations of the engine 4. However, other configurations can also be used.

In some embodiments, the ECU 10 can be configured to deactivate some of the cylinders (cylinder deactivating operation). The ECU 10 can be configured to deactivate the cylinders of the engine 4 in any known manner. For example, but without limitation, the ECU 10 can be configured to deactivate any cylinder by omitting an ignition signal to thereby disable a spark plug of a cylinder, to omit a fuel injection signal to a cylinder to thereby prevent fuel from being injected into a cylinder, to alter the fuel injection signal such that the resulting air fuel mixture is too lean or too rich to combust, to close the throttle valve of a cylinder to thereby prevent sufficient air from flowing into the cylinder, to close all of the valves of a cylinder to thereby prevent the movement of air through that cylinder, any combination of these techniques, or any other technique.

In some embodiments, the ECU 10 can be configured to deactivate some of the cylinders if an engine speed (which can be calculated based upon the crankshaft angle sensor 11*b*) exceeds a preset speed (over-revolution speed).

In some embodiments, the ECU 10 can be configured to deactivate cylinders in a step-by-step manner. That is, the ECU 10 can be configured to change the number of deactivated cylinders step by step. For example, if an engine speed does not fall below the over-revolution speed at a first step of cylinder deactivation where one of the cylinders is deactivated, the ECU 10 can move to a second step of cylinder deactivation where two of the cylinders are deactivated.

In some embodiments, the ECU 10 can have a plurality of cylinder deactivation order maps used for instructing an increment order of cylinders which are deactivated step by step. The ECU 10 can exchange one of the cylinder deactivation order maps for another one of the maps in accordance with an operation state of the engine.

Figure 4:
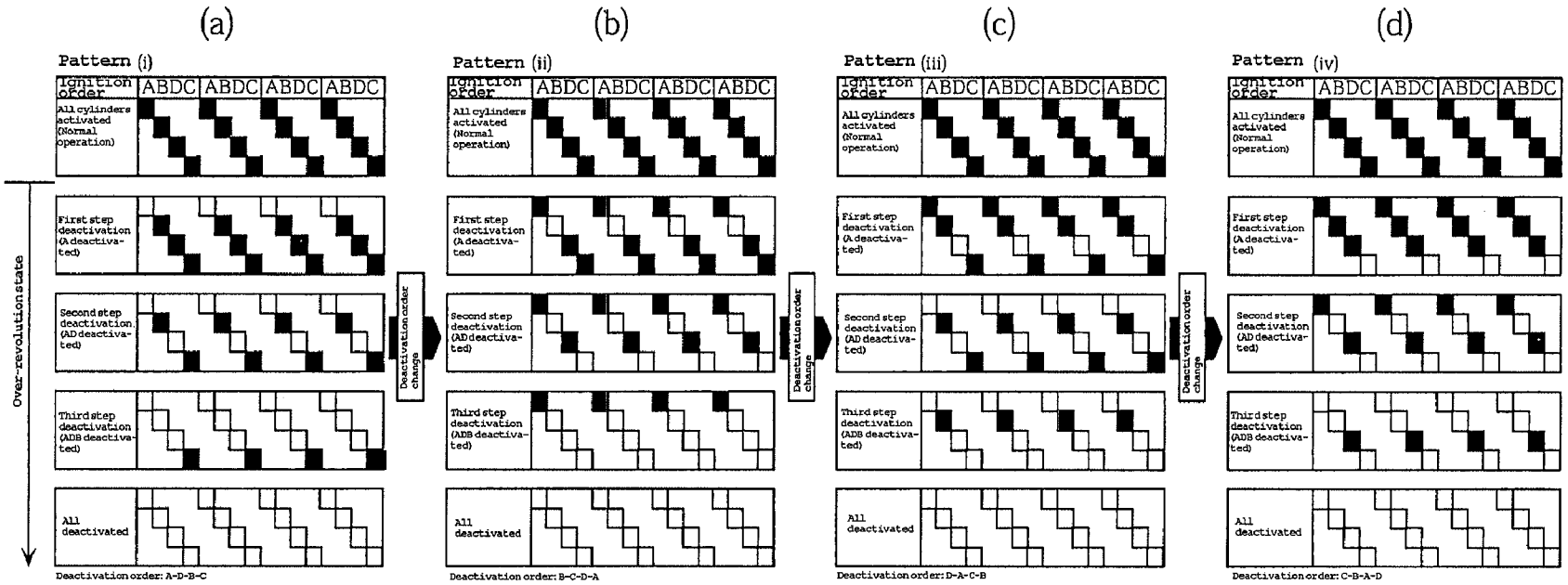
FIG. 4 is an illustration showing cylinder deactivation order maps.

For example, as shown in FIG. 4(*a*), (*b*), (*c*), (*d*), the ECU 10 can include four kinds of maps such as a pattern (i), a pattern (ii), a pattern (iii) and a pattern (iv) as the cylinder deactivation order maps. However, the ECU 10 can include other types of maps as well.

In the pattern (i), if an engine speed exceeds the over-revolution speed, the first cylinder A is deactivated under a first step of deactivation control. If the over-revolution state continues despite the control, the fourth cylinder D can be deactivated under a second step of deactivation control. Similarly, the second cylinder B can be deactivated under a third step of deactivation control and finally the third cylinder C can be deactivated under a fourth step of deactivation control. Alternatively, the third cylinder C can be deactivated instead of the second cylinder B under the third step of deactivation control.

In the pattern (ii), the second cylinder B is deactivated at the first deactivation step, then the third cylinder C, the fourth cylinder D and the first cylinder A are additionally deactivated at the second, third and fourth deactivation steps. In this pattern (ii), the cylinders which are still under activated condition in the late half (high speed revolution range) are positioned at both ends of the engine. Specifically, the cylinders are the first cylinder A and the fourth cylinder D which are not disposed next to each other. The heat loads thus can be dispersed, and rotational fluctuations due to the cylinder deactivation can be minimized. Alternatively, the first cylinder A can be deactivated instead of the fourth cylinder D under the third step of deactivation control.

In the pattern (iii), the fourth cylinder D is deactivated at the first deactivation step, then the first cylinder A, the third cylinder C and the second cylinder B are additionally deactivated at the second, third and fourth deactivation steps. Alternatively, the second cylinder B can be deactivated instead of the third cylinder C under the third step of deactivation control.

In the pattern (iv), the third cylinder C is deactivated at the first deactivation step, then the second cylinder B, the first cylinder A and the fourth cylinder D are additionally deactivated at the second, third and fourth deactivation steps. Alternatively, the fourth cylinder D can be deactivated instead of the first cylinder A under the third step of deactivation control.

In the engine 4 of the illustrated embodiment, the first cylinder A, the second cylinder B, the fourth cylinder D and the third cylinder C are ignited in this order. In some embodiments, all of the cylinder deactivation orders, such as those indicated by the patterns (i)-(iv), can differ from the ignition order.

The engine 4 includes an end cylinder group AD formed with the first cylinder A and the fourth cylinder D disposed at both ends of the crankshaft 7 and a central cylinder group BC including the second cylinder B and the third cylinder C interposed between the cylinders A, D of the end cylinder group AD. In some embodiments, such as those incorporating any one of the patterns (i)-(iv), either the end cylinder group AD or the central cylinder group BC is deactivated at the first and second deactivation, and then the remainder cylinder group is deactivated at the third and fourth deactivation steps.

For example, in the patterns (i) and (iii), the cylinders of the end cylinder group AD are deactivated at the first and second deactivation, and the cylinders of the central cylinder group BC are deactivated at the third and fourth deactivation steps. Also, in the patterns (ii) and (iv), the cylinders of the central cylinder group BC are deactivated at the first and second deactivation steps, and the cylinders of the end cylinder group AD are deactivated at the third and fourth deactivation steps.

Because the patterns (i), (ii), (iii) and (iv) are switched in this order, the cylinders that are deactivated at the first deactivation step are the first cylinder A, the second cylinder B, the fourth cylinder D and the third cylinder C with regard to the respective patterns.

The ECU 10 can also be configured to change the cylinder deactivation order maps to be used, in order of the patterns (i), (ii), (iii) and (iv), in accordance with engine operating conditions. For example, the ECU 10 can first use the pattern (i) when the engine is in the over-revolution state and then the ECU 10 can exchange the pattern (i) for the pattern (ii) when the engine speed falls below the over-revolution speed due to the use of pattern (i). The ECU 10 can then use pattern (ii) the next time the engine speed is in the over-revolution state. The ECU 10 can continue this mode of operation and exchange pattern (ii) for pattern (iii) and then exchange pattern (iii) for pattern (iv).

In some embodiments, the ECU 10 can store a current cylinder deactivation order map, for example, the pattern (i) during an operation. When the engine 4 is restarted, the ECU 10 uses the cylinder deactivation order map (i) stored in the previous operation for the pattern (ii) that is the next cylinder deactivation order map.

Figure 5:
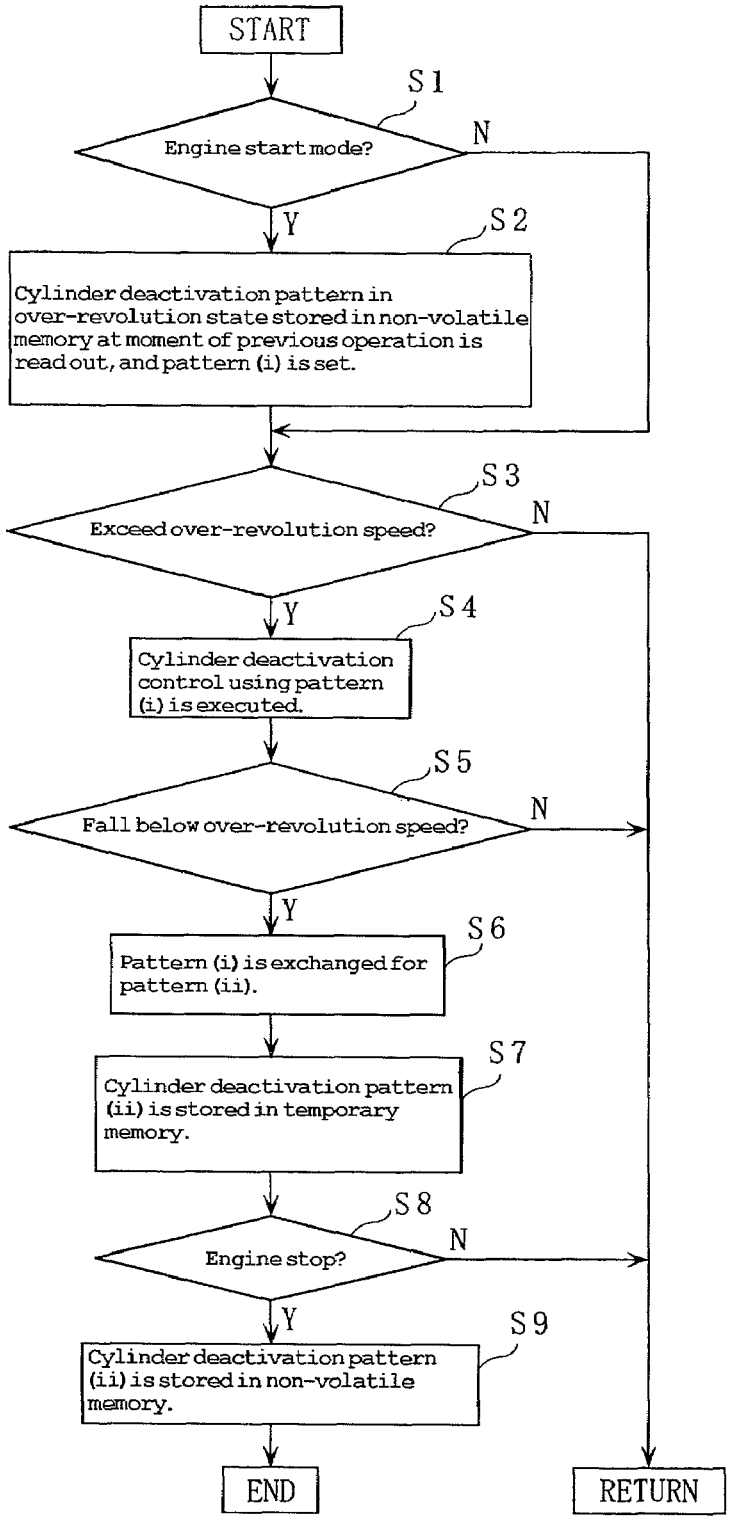
FIG. 5 is a control flowchart that can be used in controlling operation of the engine.

FIG. 5 includes a flowchart of a control routine that can be used for by the ECU 10 to exchange the cylinder deactivation order maps. The control program starts and goes to a step S1. In the step S1, it is determined if an engine start mode is activated, for example, the ECU 10 can determine if the engine is currently being started. If it is determined that the start mode is not activated, for example, if the engine is already running, the control program can skip to step S3. If it is determined that the start mode is activated, the control program can move to step S2.

In step S2, the pattern previously exchanged (e.g., in a previous performance of step S6, described below) can be read and set as the current disablement pattern. For example, if the last time the control program performed step S6 the disablement pattern was changed from pattern (iv) to pattern (i), then at the subsequent step S2, pattern (i) can be set as the current disablement pattern. The control program can then move on to step S3.

At a step S3, it can be determined whether or not the engine speed exceeds an over-revolution speed, which can be, for example, a predetermined engine speed. If it is determined that the engine speed does not exceed the over-revolution speed, the control program can return to step S1. If, on the other hand, the engine speed exceeds the over-revolution speed, the control program can move to step S4. At step S4, the current disablement pattern can be used by the ECU 10 to disable cylinders in the engine. The control program can then move on to step S5.

If it is determined, at the step S5, that the engine speed has not fallen below the over-revolution speed, the control program can return to step S1. On the other hand, if it is determined, at the step S5, that the engine speed has fallen below the over-revolution speed, the control program can move to step S6 in which the current cylinder deactivation pattern (pattern (i) in the present example) can be exchanged for the cylinder deactivation pattern (ii). In some embodiments, for example at a step S7, the new pattern (ii) can be written in a temporary memory location. If it is determined, at a step S8, that the engine stops, the control program can move to step S9 at which the new pattern (ii) can be written in the non-volatile memory location, so that the new pattern (ii) can be read after the main power of the water vehicle 1 has been switched off then back on.

The next time the engine 4 is started, the pattern (ii) which was previously stored in non-volatile memory can be used when the engine 4 exceeds the over-revolution speed (e.g., step S3, S4). When the engine speed again falls below the over-revolution speed (step S5) the next deactivation pattern (iii) can be exchanged for the current deactivation pattern (ii). If the engine speed exceeds the over-revolution speed, the cylinder deactivation control using the pattern (iii) can be executed. When the engine speed falls below the over-revolution speed again, the pattern (iii) can be exchanged for the cylinder activation pattern (iv). After the engine is stopped, the cylinder deactivation pattern (iv) can be stored in the non-volatile memory piece. At the next start moment of the engine, the control program can continue as described above.

In some embodiments, the ECU 10 can have the patterns (i)-(iv) as the cylinder deactivation order maps used for instructing the increment order of the cylinders that are deactivated, and the ECU 10 exchanges the respective patterns that are currently used for one another in accordance with an operation state of the engine. Thus, for example, the deactivated cylinders can be switched in order of the first cylinder A (pattern (i)), the second cylinder B (pattern (ii)), the third cylinder C (pattern (iii)) and the fourth cylinder D (pattern (iv)) whenever the over-revolution state occurs. Therefore, cylinders which are under a high speed condition without being deactivated in the over-revolution state can be replaced by other cylinders. Imbalance of mechanical loads to particular portions of the crankshaft and particular cylinders can be reduced or eliminated, and the loads can be dispersed to every portion of the crankshaft and every cylinder. However, other switching orders, for the engine 4 or other engines, can also be used and achieve the same or similar effects.

The illustrated ECU 10 can exchange the respective cylinder deactivation order maps for another one when the engine speed falls below the preset speed (over-revolution speed). Therefore, the cylinder deactivation order can be changed when the next over-revolution state occurs. The imbalance of mechanical loads to respective cylinders thus can be effectively reduced or eliminated.

The ECU 10 can store the current cylinder deactivation order map, for example, the pattern (i) during the operation, and the ECU 10 can exchange the pattern (i) used in the previous deactivation operation for the pattern (ii) (the next cylinder deactivation order map) when the engine is restarted. Therefore, the cylinder deactivation order maps can be reliably exchanged for one another whenever the engine starts or is restarted.

In some embodiments, the increment order of the deactivated cylinders in all of the patterns (i)-(iv) can be different from the ignition order A-B-D-C. Rotational fluctuations due to the cylinder deactivation can thus be reduced to the minimum. Additionally, the ignition order of the present embodiments is not limited to the order A-B-D-C, and can be any order insofar as the ignition order can be different from the cylinder deactivation order. More specifically, for example, orders B-D-C-A, C-A-B-D or D-C-A-B are also applicable.

Because, in some embodiments, the cylinder deactivation order maps can be exchanged in the in-line, four cylinder engine 4, the loads to the crankshaft, bearings thereof and the cylinders can be small. Therefore, the durability required to the crankshaft can be reduced, and the engine 4 can be downsized.

That is, in some embodiments, the crankshaft of the in-line engine 4 can be longer than, for example, the crankshaft of a V-type engine, and a relatively large number of cylinders, such as the second cylinder B and the third cylinder C, can be interposed between other cylinders on both sides. In this connection, no cylinder of a V-type, four cylinder engine is interposed between any other cylinders. According to the some known step-by-step cylinder deactivation control techniques, some particular cylinders are always deactivated or are deactivated more frequently than other cylinders when the over-revolution state occurs. Thus, particular portions of the crankshaft have larger mechanical loads, and heat loads to certain cylinders also increase. Because such an engine needs to withstand such loads, the engine is likely to be upsized to endure the larger mechanical and heat loads.

In some embodiments, the ECU 10 can deactivate either the end cylinder group AD or the central cylinder group BC at the first deactivation step and the second deactivation step, and can also deactivate the remaining cylinder group at the third deactivation step and the fourth deactivation step. Therefore, the cylinders which are still under activated condition in the late half (high speed range) of the step-by-step cylinder deactivation control can be divided into the cylinders disposed at both ends and the cylinders disposed at the center. Accordingly, the loads added to the crankshaft 7 can be more evenly dispersed, and the heat loads added to the second cylinder B and the third cylinder C can be reduced.

In some embodiments, the ECU 10 can exchange the patterns (i), (ii), (iii) and (iv) for one another in this order. The cylinders deactivated at the first deactivation step thus are the first cylinder A, the second cylinder B, the fourth cylinder D and the third cylinder C. Therefore, the cylinders onto which large loads are still added in the late half can be alternately allotted to the end cylinder group AD and to the central cylinder group BC, and the deactivation order can be irregular. The loads added to the respective cylinders can be dispersed, accordingly.

In some of the embodiments described in the above, the engine can be in the over-revolution state and when the engine speed falls below the over-revolution speed because of the cylinder deactivation control using the pattern (i), the cylinder deactivation order map, i.e., the pattern (i) can be exchanged for the pattern (ii), and the pattern (ii) can be exchanged for the pattern (iii) and then for the pattern (iv). However, the manner in which patterns are exchanged is not limited to the manner described above.

Figure 6:
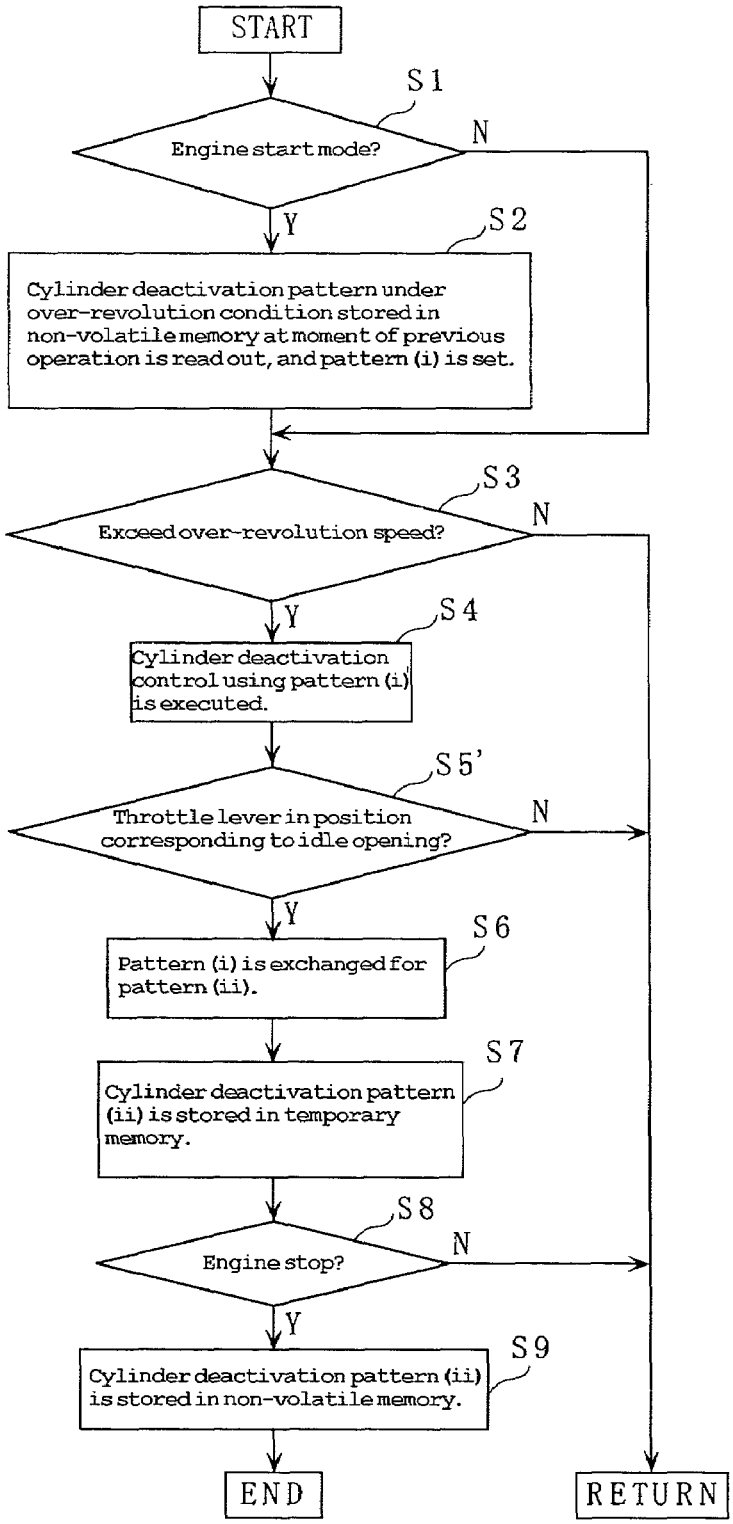
FIG. 6 is a modification of the control flowchart of FIG. 5.

For example, in some embodiments, such patterns can be exchanged in the manner illustrated in the flow chart of FIG. 6. That is, if the current cylinder deactivation order is the pattern (i), the pattern (i) can be exchanged for the pattern (ii) when an operational amount of the throttle lever 6*c* reaches zero, e.g., when a position of the throttle lever 6*c* corresponds to an idle opening of the throttle valve (step S5'), after the engine speed exceeds the over-revolution speed (steps S1-S4). Additionally, if the position of the throttle lever 6*c* corresponds to the idle opening after the over-revolution state again occurs, the pattern (ii) can be exchanged for the pattern (iii) and then for the pattern (iv).

Such a technique can reduce the calculation load (e.g., the number of mathematical calculations required) on the ECU 10. That is, an engine speed at which the ECU 10 determines whether the engine speed falls below the over-revolution speed or not is smaller in comparison with an engine speed at which the ECU 10 determines whether the operational amount of the throttle lever reaches zero or not. The calculation loads on the operation control device, which can be the ECU 10 or another device, can be reduced.

In some of the embodiments described above, the first cylinder A, the second cylinder B, the fourth cylinder D and the third cylinder C are ignited in this order. However, the ignition order that can be used with the present inventions is not limited to this order.

Figure 7:
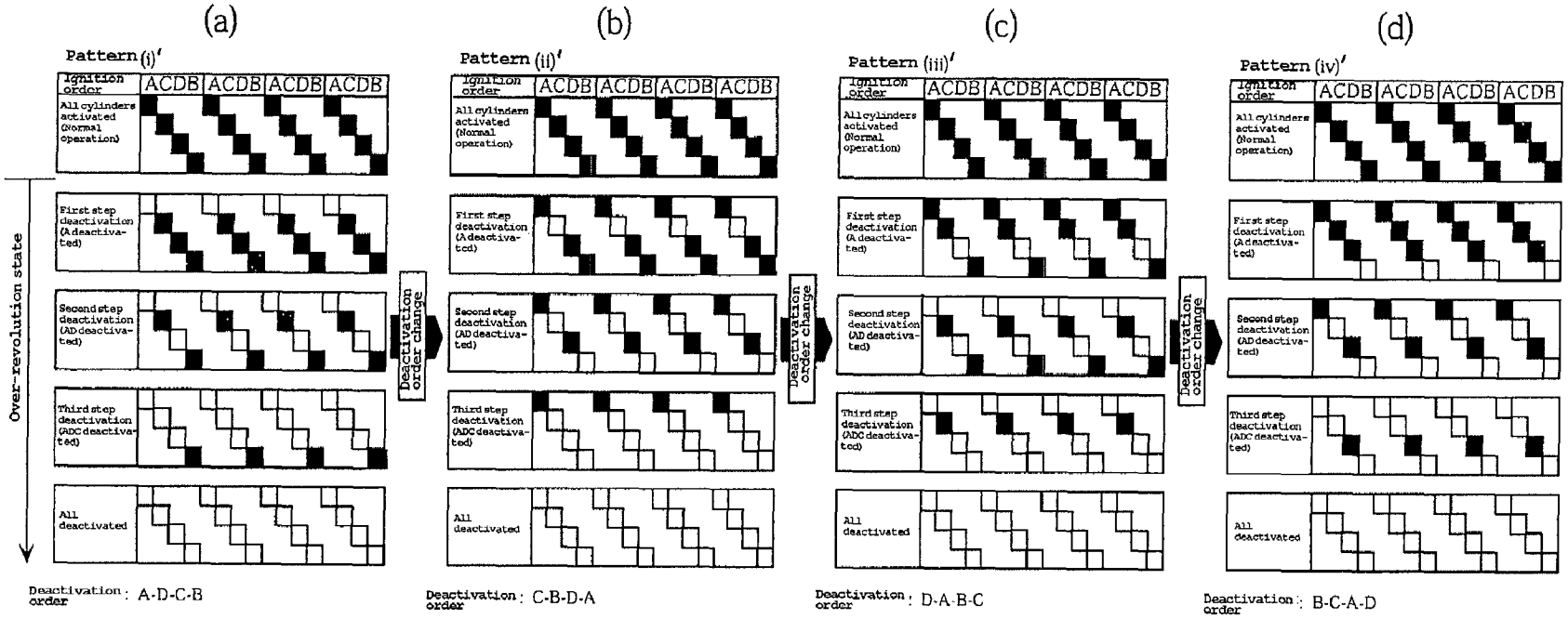
FIG. 7 is an illustration showing a modification of the cylinder deactivation order maps of FIG. 4.

For example, as illustrated in FIG. 7, the ignition order of the engine 4 can be in the order of the first cylinder A, the third cylinder C, the fourth cylinder D and the second cylinder B. Thus, in some embodiments, the ECU 10 can deactivate either the end cylinder group AD or the central cylinder group BC at the first deactivation step and the second deactivation step, and can also deactivate the remainder cylinder group at the third deactivation step and the fourth deactivation step. For example, the patterns (i)'-(iv)' can be employed as the cylinder deactivation order maps.

With continued reference to FIG. 7, the patterns (i)'-(iv)' can be used in conjunction with the control programs described above with reference to FIGS. 5 and 6, or other control programs. Thus, the description of the patterns (i)'-(iv)' set forth below are in the context of the use of the patterns (i)'-(iv)' in the control programs of FIGS. 5 and 6.

During use of the pattern (i)', if an engine speed exceeds the over-revolution speed, the first cylinder A is deactivated under the first step of deactivation control. If the over-revolution state still continues despite the deactivation of cylinder A, the fourth cylinder D can be deactivated under the second step of deactivation control. Similarly, the third cylinder C can be deactivated under the third step of deactivation control and finally the second cylinder B can be deactivated under the fourth step of deactivation control.

In the pattern (ii)', the third cylinder C can be deactivated at the first deactivation step, then the second cylinder B, the fourth cylinder D and the first cylinder A can be additionally deactivated at the second, third and fourth deactivation steps, respectively.

In the pattern (iii)', the fourth cylinder D can be deactivated at the first deactivation step, then the first cylinder A, the second cylinder B and the third cylinder C can be additionally deactivated at the second, third and fourth deactivation steps, respectively.

In the pattern (iv)', the second cylinder B can be deactivated at the first deactivation step, then the third cylinder C, the first cylinder A and the fourth cylinder D can be additionally deactivated at the second, third and fourth deactivation steps.

In some embodiments of the engine 4, the first cylinder A, the third cylinder C, the fourth cylinder D and the second cylinder B are ignited in this order. All of the cylinder deactivation orders indicated by the patterns (i)'-(iv)' can differ from the ignition order.

In any one of the patterns (i)'-(iv)', either the end cylinder group AD or the central cylinder group BC can be deactivated at the first deactivation step and the second deactivation step, and then the remainder cylinder group can be deactivated at the third deactivation step and the fourth deactivation step.

For example, in the patterns (i)' and (iii)', the cylinders of the end cylinder group AD are deactivated at the first deactivation step and the second deactivation step, and the cylinders of the central cylinder group BC are deactivated at the third deactivation step and the fourth deactivation step. Also, in the patterns (ii)' and (iv)', the cylinders of the central cylinder group BC are deactivated at the first deactivation step and the second deactivation step, and the cylinders of the end cylinder group AD are deactivated at the third deactivation step and the fourth deactivation step.

Because the patterns (i)', (ii)', (iii)' and (iv)' are switched in this order, the cylinders that are deactivated at the first deactivation step are the first cylinder A, the third cylinder C, the fourth cylinder D and the second cylinder B with regard to the respective patterns.

Although the patterns (i), (ii), (iii) and (iv) are switched in this order in the some embodiments, the switching order used with the present inventions is not limited as such. Rather, the ECU 10 can have a fifth cylinder deactivation order map whereby any one of the end cylinder group AD can be deactivated at the first deactivation step and a sixth cylinder deactivation order map whereby any one of the central cylinder group BC can be deactivated at the first deactivation step and the ECU 10 can alternately exchange the fifth and sixth cylinder deactivation order maps for one another.

According to the modified order, the cylinders onto which large loads are still added in the late half can be alternately allotted to the end cylinder group and to the central cylinder group. In addition, because only two kinds of cylinder deactivation order maps are required, a storage capacity for the maps can be small enough.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A multiple-cylinder engine for a planing water vehicle comprising an operation control device configured to change the number of deactivated cylinders step by step in response to an engine speed when the engine speed exceeds a preset speed, wherein the operation control device comprises a plurality of cylinder deactivation order maps, the operation control device being configured to use the deactivation order maps in deactivating the cylinders of the engine in an incremental order, step by step when the engine speed exceeds the preset speed, the operation control device also being configured to store a current cylinder deactivation order map during operation of the engine and to exchange one of the cylinder deactivation order maps which is currently used for a different one of the maps when the engine is restarted.

2. The multiple-cylinder engine for a planing water vehicle according to claim 1, wherein the operation control device is configured to exchange the one of the cylinder deactivation order maps for the another one when the engine speed falls below the preset speed.

3. The multiple-cylinder engine for a planing water vehicle according to claim 1, wherein the operation control device is configured to exchange the one of the cylinder deactivation order maps for the another one when an operational amount of a throttle lever which is operated by an operator reaches zero after the engine speed has exceeded the preset speed.

4. The multiple-cylinder engine for a planing water vehicle according to claim 1, wherein the increment order of the deactivated cylinders is different from an ignition order.

5. The multiple-cylinder engine for a planing water vehicle according to claim 1, wherein the engine is an in-line engine in which multiple cylinders are arranged in line.

6. The multiple-cylinder engine for a planing water vehicle according to claim 5, wherein the engine is an in-line, four cylinder engine having an end cylinder group including a first cylinder and a fourth cylinder disposed at both ends of a cylinder line and a central cylinder group including a second cylinder and a third cylinder interposed between the cylinders of the end cylinder group, wherein ignition of the engine is made in order of the first cylinder, the second cylinder, the fourth cylinder and the third cylinder, and the operation control device is configured to deactivate either the end cylinder group or the central cylinder group at a first deactivation step and a second deactivation step in the step- by-step cylinder deactivation and to deactivate the remaining cylinder group at a third deactivation step and a fourth deactivation step in the step-by-step cylinder deactivation.

7. The multiple-cylinder engine for a planing water vehicle according to claim 5, wherein the engine is an in-line, four cylinder engine having an end cylinder group including a first cylinder and a fourth cylinder disposed at both ends of a cylinder line and a central cylinder group including a second cylinder and a third cylinder interposed between the cylinders of the end cylinder group, wherein the engine is configured such that ignition of the engine is made in order of the first cylinder, the third cylinder, the fourth cylinder and the second cylinder, and wherein the operation control device is configured to deactivate either the end cylinder group or the central cylinder group at a first deactivation step and a second deactivation step in the step-by-step cylinder deactivation and to deactivate the remaining cylinder group at a third deactivation step and a fourth deactivation step in the step-by-step cylinder deactivation.

8. The multiple-cylinder engine for a planing water vehicle according to claim 6, wherein the operation control device comprises first, second, third and fourth cylinder deactivation order maps including data indicating that the cylinder deactivated at the first deactivation step is the first cylinder, the second cylinder, the third cylinder and the fourth cylinder, respectively, and wherein the operation control device is configured to exchange the first through fourth cylinder deactivation order maps for one another so that the cylinder deactivated at the first deactivation step changes in order of the first cylinder, the second cylinder, the fourth cylinder, the third cylinder and the first cylinder.

9. The multiple-cylinder engine for a planing water vehicle according to claim 7 wherein the operation control device comprises first, second, third and fourth cylinder deactivation order maps including data indicating that the cylinder deactivated at the first deactivation step is the first cylinder, the second cylinder, the third cylinder and the fourth cylinder, respectively, and wherein the operation control device is configured to exchange the first through fourth cylinder deactivation order maps for one another so that the cylinder deactivated at the first deactivation step changes in order of the first cylinder, the second cylinder, the fourth cylinder, the third cylinder and the first cylinder.

10. The multiple-cylinder engine for a planing water vehicle according to claim 5, wherein the operation control device comprises a fifth cylinder deactivation order map including data indicating that the cylinder deactivated at the first deactivation step is any cylinder of the end cylinder group and a sixth cylinder deactivation order map including data indicating that the cylinder deactivated at the first deactivation step is any cylinder of the central cylinder group, and wherein the operation control device is configured to alternately exchanges the fifth and sixth cylinder deactivation order maps for one another.

11. A multiple-cylinder engine for a planing water vehicle comprising an operation control device configured to change the number of deactivated cylinders step by step in response to an engine speed when the engine speed exceeds a preset speed, wherein the operation control device comprises a plurality of cylinder deactivation order maps, the operation control device being configured to use the deactivation order maps in deactivating the cylinders of the engine in an incremental order, step by step when the engine speed exceeds the preset speed, the operation control device also comprising means for storing a cylinder deactivation map currently used during operation and for exchanging the stored cylinder deactivation order map which is currently used for another different one of the maps when the engine is restarted after stopping.

* * * * *